US011965392B2

(12) United States Patent
Ferguson et al.

(10) Patent No.: US 11,965,392 B2
(45) Date of Patent: Apr. 23, 2024

(54) ISOLATION OF WELL SECTION

(71) Applicant: THRU TUBING SOLUTIONS, INC., Newcastle, OK (US)

(72) Inventors: Andrew M. Ferguson, Moore, OK (US); Mark S. Britton, Carter, OK (US)

(73) Assignee: THRU TUBING SOLUTIONS, INC., Newcastle, OK (US)

( * ) Notice: Subject to any disclaimer, the term of this patent is extended or adjusted under 35 U.S.C. 154(b) by 80 days.

(21) Appl. No.: 17/341,221

(22) Filed: Jun. 7, 2021

(65) Prior Publication Data

US 2021/0388692 A1 Dec. 16, 2021

Related U.S. Application Data

(60) Provisional application No. 63/039,864, filed on Jun. 16, 2020.

(51) Int. Cl.

| | |
|---|---|
| ***E21B 33/128*** | (2006.01) |
| ***E21B 23/06*** | (2006.01) |
| ***E21B 34/10*** | (2006.01) |
| ***E21B 47/06*** | (2012.01) |

(52) U.S. Cl.

CPC ..... *E21B 33/1285* (2013.01); *E21B 23/06* (2013.01); *E21B 34/10* (2013.01); *E21B 47/06* (2013.01)

(58) Field of Classification Search

CPC ..... E21B 23/06; E21B 33/1285; E21B 34/10; E21B 47/06; E21B 33/128; E21B 33/12; E21B 33/122; E21B 33/126; E21B 33/127

See application file for complete search history.

(56) References Cited

U.S. PATENT DOCUMENTS 5,435,395 A * 7/1995 Connell ..... E21B 23/14 166/77.2
5,577,560 A * 11/1996 Coronado ..... E21B 23/08 166/66.4
8,528,632 B2 * 9/2013 Mack ..... E21B 33/12 166/387

(Continued)

FOREIGN PATENT DOCUMENTS

CA 2599827 A1 * 3/2008 ..... E21B 49/082
CA 2599827 A1 3/2008

OTHER PUBLICATIONS

1 Canadian Examination Report dated Sep. 14, 2022 for CA Patent Application No. 3, 122, 169, 5 pages.

(Continued)

*Primary Examiner* — Caroline N Butcher
(74) *Attorney, Agent, or Firm* — Smith IP Services, P.C.

(57) ABSTRACT

A system can include a bottom hole assembly, a wireline and a capillary tube connected to the bottom hole assembly, and a dual pack-off assembly that seals about the wireline and the capillary tube. A method can include connecting a bottom hole assembly to a wireline and a capillary tube, deploying the bottom hole assembly into a wellbore, and increasing pressure in the capillary tube, thereby setting a packer of the bottom hole assembly. A dual pack-off assembly can include a lubricator connector, pack-offs configured to seal about a capillary tube and a wireline, and pipes connected between the respective pack-offs and the lubricator connector.

23 Claims, 3 Drawing Sheets

(56) References Cited

U.S. PATENT DOCUMENTS

| | | | | |
|---|---|---|---|---|
| 8,726,983 | B2 * | 5/2014 | Khan | E21B 17/025 166/69 |
| 2007/0000670 | A1 * | 1/2007 | Moore | E21B 43/129 166/77.2 |
| 2007/0158078 | A1 * | 7/2007 | Boyd | E21B 33/072 166/380 |
| 2009/0294136 | A1 | 12/2009 | Jones et al. | |
| 2011/0174503 | A1 * | 7/2011 | Elsayed | E21B 17/025 166/385 |
| 2018/0119542 | A1 * | 5/2018 | Wayne | E21B 47/06 |
| 2019/0390528 | A1 * | 12/2019 | Angers, Jr. | E21B 23/01 |
| 2020/0123865 | A1 * | 4/2020 | Fundytus | G01V 1/52 |

OTHER PUBLICATIONS

1 Canadian Examination Report dated Aug. 21, 2023 for CA Patent Application No. 3, 122, 169, 4 pages.

* cited by examiner

ISOLATION OF WELL SECTION

BACKGROUND

This disclosure relates generally to equipment utilized and operations performed in conjunction with a subterranean well and, in an example described below, more particularly provides for isolation of a well section.

In some situations, it may be desirable to isolate one section of a well from another section of the well. For example, if a wellhead needs to be repaired, maintained, replaced or tested, it can be useful to isolate an upper section of a wellbore from a lower section of the wellbore. For this purpose, a packer may be set in the wellbore to prevent fluid communication with the lower section of the wellbore.

Therefore, it will be readily appreciated that improvements are continually needed in the art of isolating a well section from another well section. These improvements may be useful in a variety of different well operations, whether or not a wellhead is to be repaired, maintained, replaced or tested.

DETAILED DESCRIPTION

Figure 1:
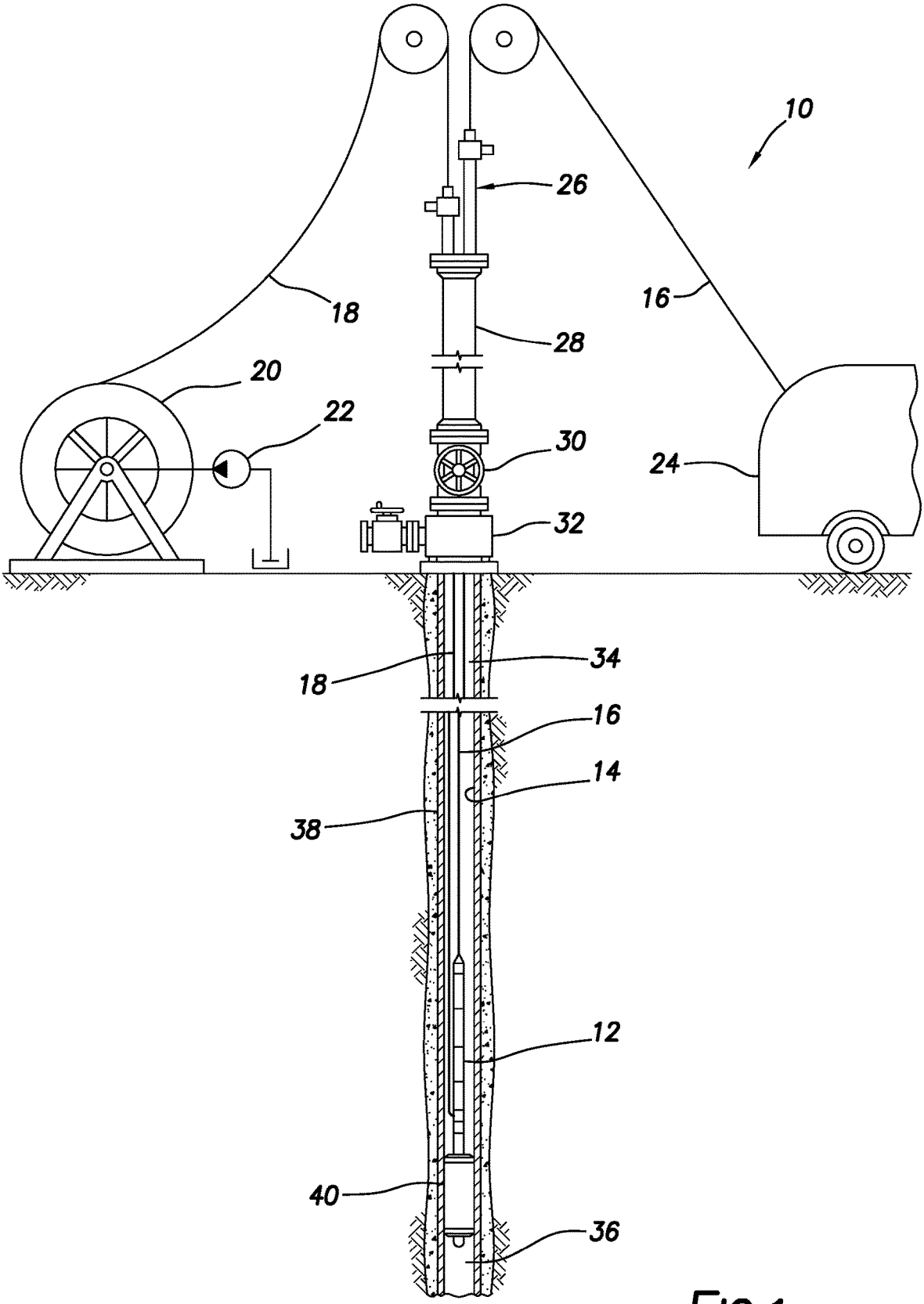
FIG. 1 is a representative partially cross-sectional view of an example of a well system and associated method which can embody principles of this disclosure.
Figure 2A:
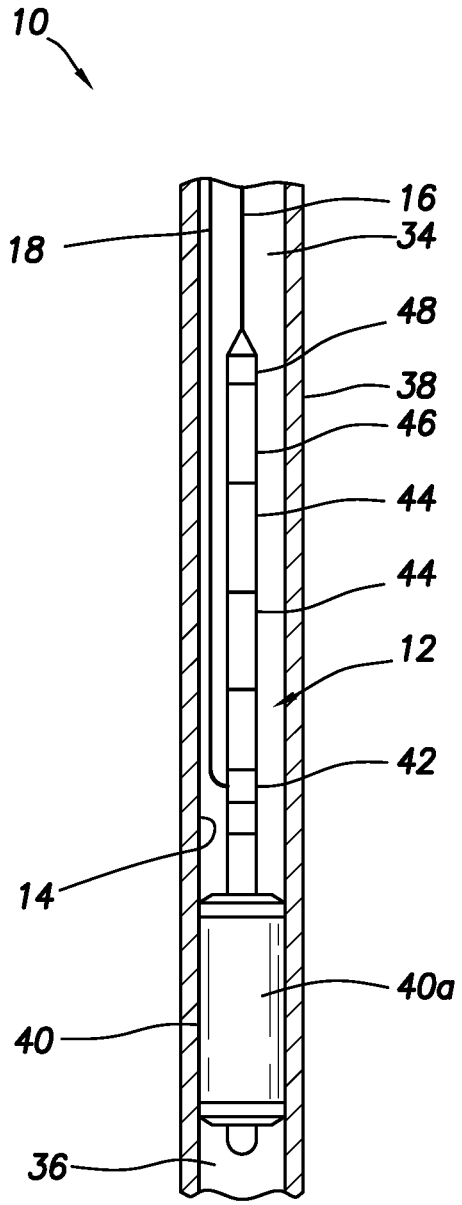
FIGS. 2A & B are representative partially cross-sectional views of different configurations of an example of a bottom hole assembly in a wellbore.
Figure 2B:
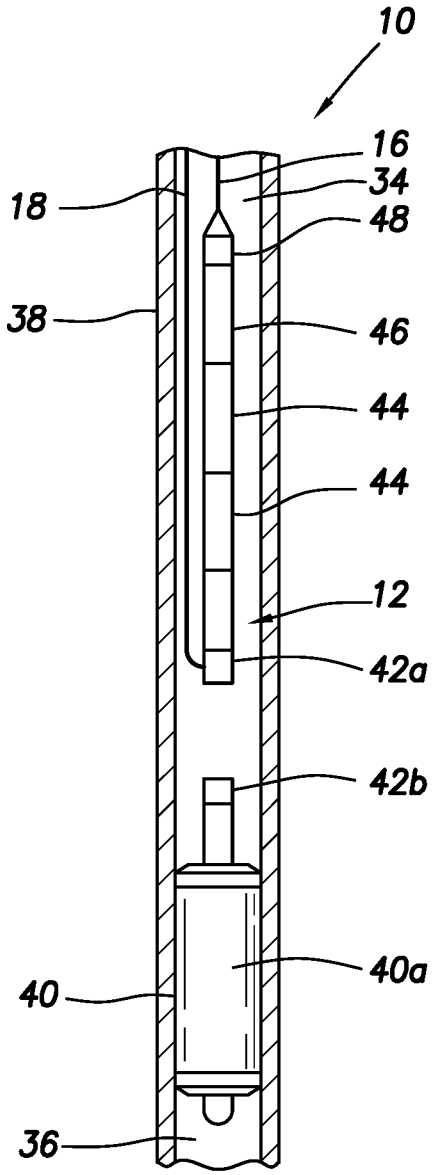
Figure 3:
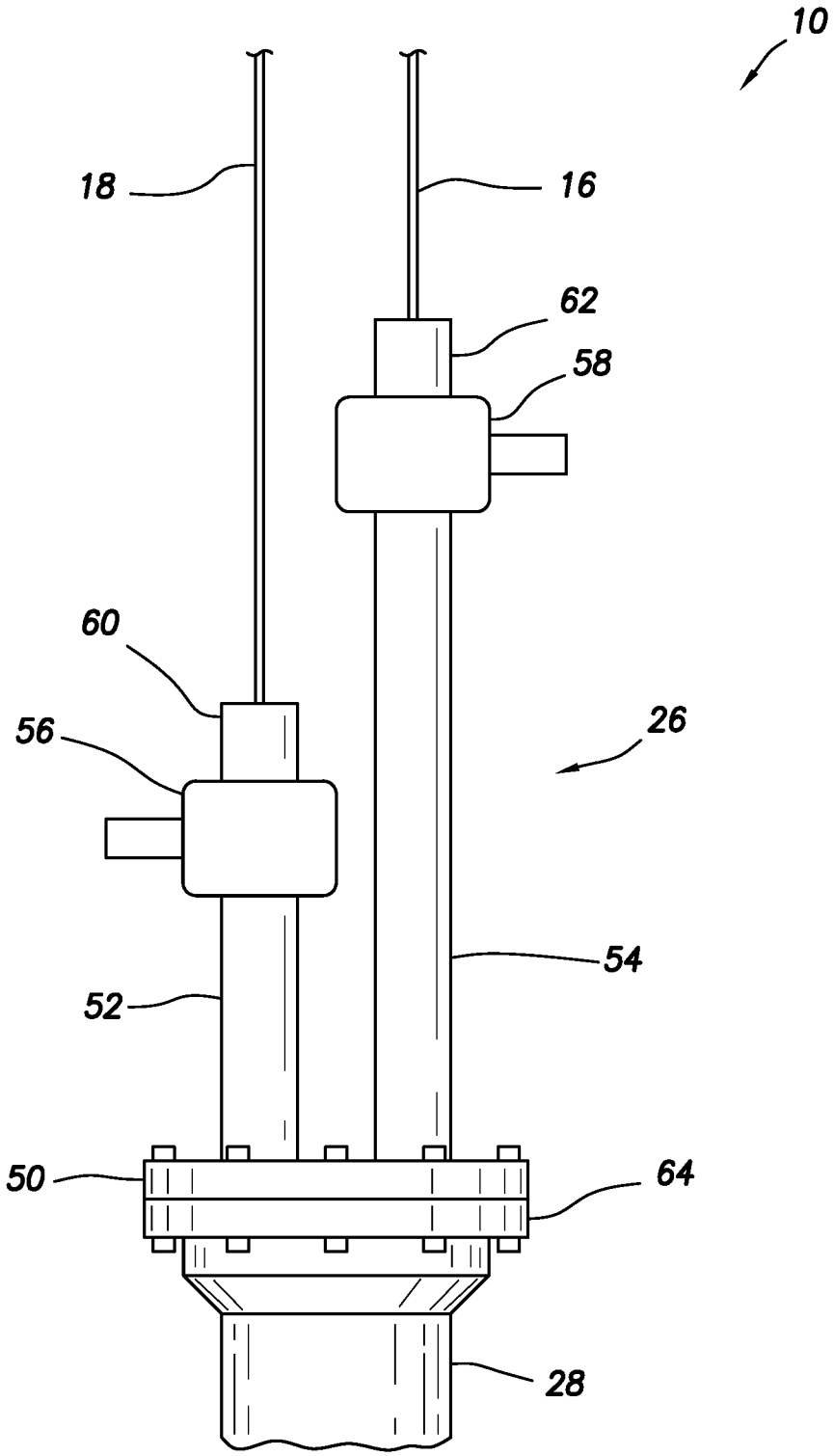
FIG. 3 is a representative side view of an example of a dual pack-off assembly that may be used in the FIG. 1 system and method.

Representatively illustrated in FIGS. 1-3 is an example of a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

As depicted in FIG. 1, a bottom hole assembly 12 has been deployed into a wellbore 14. The bottom hole assembly 12 is conveyed in the wellbore 14 by means of a wireline 16. A capillary tube 18 is also connected to the bottom hole assembly 12.

As used herein, the term "wireline" is used to indicate a means of conveying well tools in a well, and which includes one or more wires or an armored cable. The term "wireline" includes those conveyances known to those skilled in the art as "e-line" or "slickline." A wireline may include one or more electrical conductors in addition to the one or more wires or armored cable. Wireline is typically stored on a reel or spool contained in a vehicle 24 for land-based operations, or on a skid for water-based operations. However, the scope of this disclosure is not limited to any particular means of storing or transporting the wireline 16.

As used herein, the term "capillary tube" is used to indicate a substantially continuous relatively small diameter (e.g., approximately 0.25 inch diameter) tubing of the type used to transmit pressure and/or fluid flow in a well. A pump 22 can be connected to the capillary tube 18 for applying increased pressure to an interior of the capillary tube. Capillary tube is typically stored on a reel or spool 20. However, the scope of this disclosure is not limited to any particular means of storing or transporting the capillary tube 18.

As used herein the term "bottom hole assembly" is used to indicate a tool assembly connected at or near a distal end of a well conveyance. It is not necessary for a bottom hole assembly to be positioned at or near a "bottom" of a wellbore.

In the FIG. 1 example, the wireline 16 and the capillary tube 18 are deployed into the wellbore 14 by means of a dual pack-off assembly 26 connected above a lubricator 28. The lubricator 28 is installed above a master valve 30 on a wellhead 32. The lubricator 28 is preferably long enough to accommodate the bottom hole assembly 12 therein. The dual pack-off assembly 26 provides for insertion of both of the wireline 16 and the capillary tube 18 into the lubricator 28 with the bottom hole assembly 12.

In this example, it is desired to isolate an upper section 34 of the wellbore 14 from a lower section 36 of the wellbore. This situation could occur, for example, in the event that the wellhead 32 or a component thereof is in need of maintenance or replacement. Alternatively, it may be desired to perform a pressure test, for example, to pressure test the wellhead 32 or a casing 38 that lines the wellbore 14. However, the scope of this disclosure is not limited to any particular purpose for deploying the bottom hole assembly 12 into the wellbore 14.

As depicted in FIG. 1, the bottom hole assembly 12 includes an inflatable packer 40. The packer 40 is inflated or set by applying increased pressure to the capillary tube 18 after the bottom hole assembly 12 has been conveyed to a desired position in the wellbore 14. When set, the packer 40 isolates the upper section 34 of the wellbore 14 from the lower section 36 of the wellbore.

Note that it is not necessary for the packer 40 to be an inflatable packer. In other examples, the packer 40 could be a pressure actuated packer having one or more non-inflatable but radially extendable seal elements. Thus, the scope of this disclosure is not limited to use of any particular type of packer.

An inflatable packer may be used in situations in which an internal restriction prevents use of a conventional packer. For example, there could be an inner restriction in the wellhead 32 or in the casing 38.

As used herein, the term "packer" indicates a well barrier that is settable downhole and suitable to isolate sections of a wellbore from each other. For example, the packer 40 could be of the type known to those skilled in the art as a plug or "bridge plug."

Referring additionally now to FIGS. 2A & B, the bottom hole assembly 12 is representatively illustrated in different configurations. However, the scope of this disclosure is not limited to any particular configurations of the bottom hole assembly 12. The FIGS. 2A & B bottom hole assembly 12 may be used in the FIG. 1 system 10 and method, or it may be used in other systems and methods.

In FIG. 2A, it may be seen that this example of the bottom hole assembly 12 includes the packer 40, a pressure actuated disconnect tool 42, weight bars 44, a collar locator 46, and a rope socket or wireline connector 48. The bottom hole assembly 12 may include more or less components, or different combinations of components, in other examples.

In FIG. 2A, the packer 40 has been set in the wellbore 14 by applying increased pressure to the capillary tube 18. Note that the capillary tube 18 in this example is connected to the disconnect tool 42, so the increased pressure is delivered to the packer 40 via the disconnect tool. In other examples, the capillary tube 18 could be connected directly to the packer 40, or it could be otherwise connected to the bottom hole assembly 12.

Preferably, a valve assembly of the packer 40 isolates an inflatable seal element 40*a* of the packer from the capillary tube 18 when a predetermined inflation pressure has been applied to the interior of the seal element (or when a predetermined pressure differential from the interior of the seal element to the wellbore 14 external to the seal element has been applied). This will prevent over-inflation of the seal element 40*a*. Pressure in the upper wellbore section 34 can be bled off at surface after the packer 40 is set, if desired.

If it is desired to conduct a pressure test of the casing 38 or wellhead 32, increased pressure can be applied to the wellbore upper section 34. At this point, the upper section 34 is isolated from the lower section 36. The disconnect tool 42 may not be needed in the bottom hole assembly 12 if only a pressure test is to be conducted since, after the pressure test, the packer 40 can be deflated or unset, and the bottom hole assembly 12 can be retrieved from the wellbore 14. Nonetheless, it may be desired to include the disconnect tool 42 in the bottom hole assembly 12 in this situation, in case difficulty is encountered in deflating or unsetting the packer 40 after the pressure test.

In FIG. 2B, the bottom hole assembly 12 is depicted after the disconnect tool 42 has been actuated, thereby separating an upper portion 42*a* of the disconnect tool from a lower portion 42*b* of the disconnect tool. The bottom hole assembly 12 above the disconnect tool 42 (including the upper portion 42*a* of the disconnect tool) can now be retrieved from the wellbore 14, leaving the set packer 40 and the lower portion 42*b* of the disconnect tool in the wellbore. While the bottom hole assembly 12 above the disconnect tool 42 is being retrieved, the wireline 16 and capillary tube 18 are spooled back onto their respective reels or spools.

It may be desired to actuate the disconnect tool 42 as depicted in FIG. 2B if, for example, the wellhead 32 is to be repaired or replaced, or if the packer 40 cannot be deflated or unset after a pressure test. The disconnect tool 42 is actuated in this example by applying increased pressure to the capillary tube 18. The increased pressure used to actuate the disconnect tool 42 can be greater than the increased pressure used to set the packer 40.

After the wellhead 32 is repaired or replaced, or it is otherwise desired to retrieve the packer 40, a packer unsetting tool or a fishing tool may be conveyed into the wellbore 14 (for example, using the wireline 16). The packer unsetting tool or fishing tool can be used to latch onto the packer 40 or the lower portion 42*b* of the disconnect tool 42, equalize pressure across the packer, deflate or unset the packer, and then retrieve the packer to surface. Pressure across the packer 40 may be equalized, for example, by actuating the packer unsetting tool to open an equalization valve of the packer, by applying increased pressure to the upper wellbore section 34 (e.g., using pressurized gas), etc.

Referring additionally now to FIG. 3, a more detailed view of an example of the dual pack-off assembly 26 is representatively illustrated. The FIG. 3 dual pack-off assembly 26 may be used with the system 10 and method of FIG. 1, or it may be used with other systems and methods.

In the FIG. 3 example, the dual pack-off assembly 26 includes a lubricator connector or lower flange 50, pipes 52, 54, blowout preventers 56, 58 and pack-offs 60, 62. The lower flange 50 is dimensioned to connect to an upper flange 64 of the lubricator 28. In other examples, the flanges 50, 64 could be other types of tubular connectors, such as, internally and externally threaded connectors, etc.

The wireline 16 extends through the pack-off 62, blowout preventer 58, pipe 54 and flange 50. The capillary tube 18 extends through the pack-off 60, blowout preventer 56, pipe 52 and flange 50. The pack-offs 60, 62 seal about the respective capillary tube 18 and wireline 16. The blowout preventers 56, 58 can seal about the respective capillary tube 18 and wireline 16 if necessary (for example, in the event of failure of the associated pack-off 60, 62).

It may now be fully appreciated that the above disclosure provides significant advancements to the art of isolating sections of a well from each other. In one example described above, a bottom hole assembly 12 can be conveyed into a wellbore 14 with a wireline 16 while a capillary tube 18 is also connected to the bottom hole assembly.

A system 10 method are described above, in which a wireline 16 and a capillary tube 18 are deployed simultaneously into a well. A bottom hole assembly 12 may be connected to the wireline 16 and the capillary tube 18, with the bottom hole assembly including a packer 40 configured to be set by pressure in the capillary tube 18.

The packer 40 may be an inflatable packer configured to be set by the pressure in the capillary tube 18. The bottom hole assembly 12 may include a pressure actuated disconnect tool 42 configured to be disconnected by pressure in the capillary tube 18.

A method described above can comprise: connecting a bottom hole assembly 12 to both of a wireline 16 and a capillary tube 18; deploying the bottom hole assembly 12 into a wellbore 14 while the bottom hole assembly is connected to the wireline 16 and the capillary tube 18; and increasing pressure in the capillary tube 18, thereby setting a packer 40 of the bottom hole assembly 12 in the wellbore 14.

The method may include further increasing pressure in the capillary tube 18, thereby disconnecting a disconnect tool 42 of the bottom hole assembly 12. The method may further include retrieving the bottom hole assembly 12 above the disconnect tool 42 from the well while the packer 40 remains set in the wellbore 12.

The step of setting the packer 40 may include inflating the packer. The step of increasing pressure in the capillary tube 18 can include transmitting the pressure to the packer 40 via a pressure actuated disconnect tool 42 of the bottom hole assembly 12.

A system 10 for use with a subterranean well is provided to the art by the above disclosure. In one example, the system 10 can comprise: a bottom hole assembly 12; a wireline 16 connected to the bottom hole assembly 12; a capillary tube 18 connected to the bottom hole assembly 12; and a dual pack-off assembly 26 that seals about each of the wireline 16 and the capillary tube 18.

The bottom hole assembly 12 may include a packer 40 that is settable in the well in response to a first pressure applied to the capillary tube 18. The packer 40 may comprise an inflatable packer.

The bottom hole assembly 12 may include a pressure actuated disconnect tool 42 that is releasable in response to a second pressure applied to the capillary tube 18. The second pressure may be greater than the first pressure.

The dual pack-off assembly 26 may include first and second blowout preventers 56, 58, and first and second pack-offs 60, 62. The capillary tube 18 may extend through the first blowout preventer 56 and the first pack-off 60. The wireline 16 may extend through the second blowout preventer 58 and the second pack-off 62.

A lubricator 28 may be connected longitudinally between the dual pack-off assembly 26 and a wellhead 32 of the well. The bottom hole assembly 12 may be receivable in the lubricator 28 while the capillary tube 18 and the wireline 16 extend through the dual pack-off assembly 26.

The capillary tube 18 may be connected to a pressure actuated disconnect tool 42 of the bottom hole assembly 12. Pressure in the capillary tube 18 may be transmittable to a packer 40 of the bottom hole assembly 12 via the pressure actuated disconnect tool 42.

The wireline 16 may be connected to a wireline connector 48 of the bottom hole assembly 12. The capillary tube 18 may be connected to the bottom hole assembly 12 at a position longitudinally between the wireline connector 48 and a packer 40 of the bottom hole assembly 12.

The above disclosure also provides a method to the art. In one example, the method can comprise: connecting a bottom hole assembly 12 to both of a wireline 16 and a capillary tube 18; deploying the bottom hole assembly 12 into a wellbore 14 while the bottom hole assembly 12 is connected to the wireline 16 and the capillary tube 18; and increasing pressure in the capillary tube 18, thereby setting a packer 40 of the bottom hole assembly 12 in the wellbore 14.

The method may include further increasing the pressure in the capillary tube 18, thereby disconnecting a pressure actuated disconnect tool 42 of the bottom hole assembly 12. The method may include retrieving the bottom hole assembly 12 above the disconnect tool 42 from the wellbore 14 while the packer 40 remains set in the wellbore 14.

The setting step may include inflating the packer 40. The step of increasing pressure in the capillary tube 18 may include transmitting the pressure to the packer 40 via a pressure actuated disconnect tool 42 of the bottom hole assembly 12.

The connecting step may include extending the wireline 16 and the capillary tube 18 through a dual pack-off assembly 26. The extending step may include extending the capillary tube 18 through a first blowout preventer 56 and a first pack-off 60 of the dual pack-off assembly 26, and extending the wireline 16 through a second blowout preventer 58 and a second pack-off 62 of the dual pack-off assembly 26. The deploying step may include receiving the bottom hole assembly 12 in a lubricator 28 connected longitudinally between the dual pack-off assembly 26 and a wellhead 32.

The connecting step may include connecting the wireline 16 to a wireline connector 48 of the bottom hole assembly 12, and connecting the capillary tube 18 to the bottom hole assembly 12 at a location longitudinally between the wireline connector 48 and a packer 40 of the bottom hole assembly 12. A pressure actuated disconnect tool 42 may be connected in the bottom hole assembly 12 at the location longitudinally between the wireline connector 48 and the packer 40.

A dual pack-off assembly for use with a subterranean well is also described above. In one example, the dual pack-off assembly 26 can comprise a lubricator connector 50, a first pack-off 60 configured to seal about a capillary tube 18, a second pack-off 62 configured to seal about a wireline 16, a first pipe 52 connected between the first pack-off 60 and the lubricator connector 50, and a second pipe 54 connected between the second pack-off 62 and the lubricator connector 50. The lubricator connector 50 may comprise a flange.

The dual pack-off assembly 26 may include a blowout preventer 56 connected between the first pack-off 60 and the lubricator connector 50. The dual pack-off assembly may include a blowout preventer 58 connected between the second pack-off 62 and the lubricator connector 50.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A system for use with a subterranean well, the system comprising:

a bottom hole assembly;

a wireline connected to the bottom hole assembly;

a capillary tube connected to the bottom hole assembly, in which the bottomhole assembly and the capillary tube are conveyed in the well by the wireline; and a dual pack-off assembly that seals about each of the wireline and the capillary tube while both the wireline and the capillary tube are deployed in the well, in which the dual pack-off assembly includes first and second blowout preventers, and first and second pack-offs, the capillary tube extending through the first blowout preventer and the first pack-off, and the wireline extending through the second blowout preventer and the second pack-off.

2. The system of claim 1, in which the bottom hole assembly includes a packer that is settable in the well in response to a first pressure applied to the capillary tube.

3. The system of claim 2, in which the packer comprises an inflatable packer.

4. The system of claim 2, in which the bottom hole assembly includes a pressure actuated disconnect tool that is releasable in response to a second pressure applied to the capillary tube.

5. The system of claim 4, in which the second pressure is greater than the first pressure.

6. The system of claim 1, in which a lubricator is connected longitudinally between the dual pack-off assembly and a wellhead of the well.

7. The system of claim 6, in which the bottom hole assembly is receivable in the lubricator while the capillary tube and the wireline extend through the dual pack-off assembly.

8. The system of claim 1, in which the capillary tube is connected to a pressure actuated disconnect tool of the bottom hole assembly, and pressure in the capillary tube is transmittable to a packer of the bottom hole assembly via the pressure actuated disconnect tool.

9. The system of claim 1, in which the wireline is connected to a wireline connector of the bottom hole assembly, and the capillary tube is connected to the bottom hole assembly at a position longitudinally between the wireline connector and a packer of the bottom hole assembly.

10. A method, comprising:

connecting a bottom hole assembly to both of a wireline and a capillary tube;

deploying the bottom hole assembly into a wellbore while the bottom hole assembly is connected to the wireline and the capillary tube, in which the wireline extends through a first pack-off, in which the capillary tube extends through a second pack-off, and in which the bottomhole assembly and the capillary tube are conveyed in the wellbore by the wireline; and increasing pressure in the capillary tube, thereby setting a packer of the bottom hole assembly in the wellbore.

11. The method of claim 10, further comprising further increasing the pressure in the capillary tube, thereby disconnecting a pressure actuated disconnect tool of the bottom hole assembly.

12. The method of claim 11, further comprising retrieving the bottom hole assembly above the disconnect tool from the wellbore while the packer remains set in the wellbore.

13. The method of claim 10, in which the setting comprises inflating the packer.

14. The method of claim 10, in which the increasing pressure in the capillary tube comprises transmitting the pressure to the packer via a pressure actuated disconnect tool of the bottom hole assembly.

15. The method of claim 10, in which the first and second pack-offs are part of a dual pack-off assembly.

16. The method of claim 15, in which the capillary tube extends through a first blowout preventer and the first pack-off of the dual pack-off assembly, and in which the wireline extends through a second blowout preventer and the second pack-off of the dual pack-off assembly.

17. The method of claim 15, in which the deploying comprises receiving the bottom hole assembly in a lubricator connected longitudinally between the dual pack-off assembly and a wellhead.

18. The method of claim 15, in which the connecting comprises connecting the wireline to a wireline connector of the bottom hole assembly, and connecting the capillary tube to the bottom hole assembly at a location longitudinally between the wireline connector and the packer of the bottom hole assembly.

19. The method of claim 18, in which a pressure actuated disconnect tool is connected in the bottom hole assembly at the location longitudinally between the wireline connector and the packer.

20. A dual pack-off assembly for use with a subterranean well, the dual pack-off assembly comprising:

a lubricator connector;

a first pack-off configured to seal about a capillary tube;

a second pack-off configured to seal about a wireline;

a first blowout preventer connected between the first pack-off and the lubricator connector; and a second blowout preventer connected between the second pack-off and the lubricator connector.

21. The dual pack-off assembly of claim 20, in which the lubricator connector comprises a flange.

22. The dual pack-off assembly of claim 20, further comprising a first pipe connected between the first pack-off and the lubricator connector.

23. The dual pack-off assembly of claim 20, further comprising a second pipe connected between the second pack-off and the lubricator connector.

* * * * *